US010818114B2

(12) United States Patent
Chae et al.

(10) Patent No.: US 10,818,114 B2
(45) Date of Patent: Oct. 27, 2020

(54) ACCESS RIGHT MANAGEMENT METHOD OF ACCESS CONTROL SYSTEM, AND COMPUTER-READABLE RECORDING MEDIUM RECORDING PROGRAM PERFORMING THE METHOD

(71) Applicant: SHINHWA Co., Ltd., Seoul (KR)

(72) Inventors: Kwan Suk Chae, Gyeonggi-do (KR); Yoon Jae Park, Gyeonggi-do (KR)

(73) Assignee: SHINHWA Co., Ltd., Seoul (KR)

( * ) Notice: Subject to any disclaimer, the term of this patent is extended or adjusted under 35 U.S.C. 154(b) by 0 days.

(21) Appl. No.: 16/226,017

(22) Filed: Dec. 19, 2018

(65) Prior Publication Data

US 2019/0206164 A1 Jul. 4, 2019

(30) Foreign Application Priority Data

Dec. 28, 2017 (KR) ..... 10-2017-0181868

(51) Int. Cl.

| | |
|---|---|
| ***G07C 9/00*** | (2020.01) |
| ***G07C 9/32*** | (2020.01) |
| ***G07C 9/38*** | (2020.01) |
| ***G07C 11/00*** | (2006.01) |

(52) U.S. Cl.

CPC ..... *G07C 9/00309* (2013.01); *G07C 9/00571* (2013.01); *G07C 9/32* (2020.01); *G07C 9/38* (2020.01); *G07C 11/00* (2013.01); *G07C 2209/02* (2013.01); *G07C 2209/04* (2013.01)

(58) Field of Classification Search

CPC ..... G07C 9/00134; G07C 9/00166; G07C 9/00309; G07C 9/00571

See application file for complete search history.

(56) References Cited

U.S. PATENT DOCUMENTS 8,866,586 B2 * 10/2014 Hayashi ..... G06F 21/32 340/5.81

FOREIGN PATENT DOCUMENTS

| | | |
|---|---|---|
| KR | 10-0991850 B1 | 11/2010 |
| KR | 10-1610657 B1 | 4/2016 |

* cited by examiner

*Primary Examiner* — Quan-Zhen Wang
*Assistant Examiner* — Rajsheed O Black-Childress
(74) *Attorney, Agent, or Firm* — IP Legal Services, LLC

(57) ABSTRACT

The present invention relates to an access right management method of an access control system, and an object of the present invention is to provide an access right management method, which can fetch a synchronized personnel information file from a personnel management server and automatically check whether there is personnel information corresponding to a factor for determining an access right in the personnel information in the personnel information file; and automatically identify personnel information corresponding to the factor if the personnel information exists, automatically generate an access right value of a corresponding visitor by matching the personnel information to an entrance door recognition device of each access group corresponding to the personnel information, and register and store the access right value in an access control operation server, so that efficiency of operating the access management is maximized.

8 Claims, 5 Drawing Sheets

ACCESS RIGHT MANAGEMENT METHOD OF ACCESS CONTROL SYSTEM, AND COMPUTER-READABLE RECORDING MEDIUM RECORDING PROGRAM PERFORMING THE METHOD

CROSS REFERENCE TO PRIOR APPLICATIONS

The present application claims priority under 35 U.S.C. § 119 to Korean Patent Application No. 10-2017-0181868 (filed on Dec. 28, 2017).

BACKGROUND OF THE INVENTION

Field of the Invention

The present invention relates to an access right management method of an access control system and a computer-readable medium recording a program for performing the method, and more specifically, to an access right management method of an access control system and a computer-readable medium recording a program for performing the method, which allows creation and registration of an access right of a corresponding visitor by automatically setting the access right of the visitor for each access group (upper and lower groups) in real-time on the basis of new and updated personnel information of each visitor for an access control system installed and operated in a facility which requires security.

Background of the Related Art

Generally, a large number of visitors related to various civil services and jobs come in and go out of facility institutions such as public institutions, companies, R&D centers and the like, and internal visitors belonging to the facility institutions, external visitors related to jobs, and external visitors unrelated to jobs are intermixed in the visitors. There is a plurality of upper groups (upper access spaces) including one or more small scale lower groups (lower access spaces) and partitioned in a large scale in the facility institutions, and an access control system operates to allow only permitted visitors to access the upper and lower groups.

The conventional access control system like this is connected to an entrance door control/recognition means installed at an entrance door for entering the access groups to compare recognition information received from the entrance door control/recognition means and approve access of only permitted visitors to each of the upper and lower groups. That is, a visitor may access only the upper and lower groups permitted to the visitor to access.

Such a conventional access control system and a method thereof are disclosed in Korean Patent Registration Nos. 10-1610657 (registered on Apr. 4, 2016) and 10-0991850 (registered on Oct. 28, 2010).

However, these conventional techniques only allow a visitor to access by recognizing only the visitors having an access right among corresponding visitors when the visitor is to access an access space (upper and lower spaces) and do not mention at all about visitor access right matching for allowing the visitors to access only permitted access spaces by matching an access right according to departments, duties and various features of the visitors.

Since the present invention relates to a method of matching an access right of a visitor for an access control system installed and operated in a public or civil facility institution (building), it should be understood that only the method of matching an access right of a visitor for an access control system is described in the specification described below.

In the conventional method of matching an access right of a visitor for an access control system, an access control manager operates the access control system in a facility institution configured of a plurality of access groups by manually inputting access rights one by one according to the department, job and the like of each visitor and matching an access right of each visitor to an access space.

However, since the conventional method of matching an access right of a visitor for an access control system is a method of matching an access right to each visitor by identifying employment, resignation, department, duties and the like of an access target person and manually registering and storing the identified information in an access control server by a manager of the access control system, and reasons of changing access rights of a plurality of visitors are frequently generated as new employees are registered, or the departments or duties of access right holders are changed, or the access right holders resign, it is difficult to identify the reasons in real-time and change registration of the access right. In addition, since registration of an access right of a resigned employee is not cancelled sometimes, there is a problem in that a resigned employee enters a restricted access space without permission using an access recognition means of the corresponding resigned employee for an extended period of time, and causes various crimes and generates great damages to the corresponding institution.

SUMMARY OF THE INVENTION

Therefore, the present invention has been made in view of the above problems, and it is an object of the present invention to provide an access right management method of an access control system and a computer-readable medium recording a program for performing the method, which can fetch a synchronized personnel information file from a personnel management server and automatically check whether there is personnel information corresponding to a factor for determining an access right in the personnel information in the personnel information file; automatically identify personnel information corresponding to the factor if the personnel information exists, automatically generate an access right value of a corresponding visitor by matching the personnel information to an entrance door control/recognition means of each upper or lower group corresponding to the personnel information, and register and store the access right value in an access control operation server; and create and register an access right value of a previously registered visitor by reflecting updated personnel information in real-time even when the personnel information is frequently changed later, so that efficiency of operating the access management is maximized, and damages caused by illegal access of an unpermitted visitor can be prevented.

To accomplish the above object, according to one aspect of the present invention, there is provided an access right management method of an access control system for controlling visitors, the access control system including: an access management server connected to a personnel management server through a bidirectional communication network to have synchronized personnel information; and a plurality of entrance door control/recognition means installed at an entrance door of each access space partitioned into a plurality of diverse areas to recognize visitors and lock/unlock the entrance door, and connected to the access control server, respectively, wherein the method comprises: a risk response operation setting step of setting a response operation in response to generation of a risk including a fire, an earthquake, a terror or a trespass; an access group forming step of forming one or more upper and lower groups by partitioning a space into as many spaces as needed, assigning an identification code to each of the upper and lower groups, and determining a type of an entrance door control/recognition means for each identification code, when the risk response operation setting step is completed; a visitor's basic condition setting step of setting basic conditions of a visitor, when the access group forming step is completed; a visitor's special condition setting step of setting special conditions of a visitor for whom the basic conditions are set at the access group forming step; a visitor access right value generation and registration step of generating an access right value of a corresponding visitor and registering the generated access right value, when the visitor's special condition setting step is completed; a visitor addition conformation step of confirming whether there is a visitor to be added when the visitor access right value generation and registration step is completed, and returning to the visitor's basic condition setting step if there is a visitor to be added; an interrupt information reception conformation step of confirming whether interrupt information according to change of personnel information is received from a personnel management server; a basic condition information conformation step of confirming whether the received interrupt information is personnel information corresponding to basic condition information, when the interrupt information is received at the interrupt information reception conformation step; a basic condition re-setting step of re-setting the basic information on a corresponding visitor if it is confirmed at the basic condition information conformation step that the received interrupt information is personnel information corresponding to basic condition information, and returning to the visitor access right value generation and registration step; a special condition information conformation step of confirming whether the received interrupt information is personnel information corresponding to special condition information if it is confirmed at the basic condition information conformation step that the received interrupt information is not the basic condition information, and returning to the interrupt information reception conformation step if the received interrupt information is not personnel information corresponding to the special condition information; and a special condition re-setting step of re-setting the special condition of a corresponding visitor if it is confirmed at the special condition information conformation step that the received interrupt information is personnel information corresponding to special condition information, and returning to the visitor access right value generation and registration step.

In the access right management method of an access control system of the present invention as described above, the access group forming step includes: an upper group number determination step of determining the number of needed upper groups; an upper group entrance door control/recognition means determination step of determining an upper group entrance door control/recognition means of an entrance door for entering the upper group and assigning an identification code to each upper group entrance door control/recognition means, if the number of upper groups is determined at the upper group number determination step; an upper group-specific lower group number determination step of determining the number of lower groups corresponding to each upper group; a lower group entrance door control/recognition means determination step of determining a lower group entrance door control/recognition means of an entrance door for entering each lower group and assigning an identification code to each lower group entrance door control/recognition means, if the number of lower groups in each upper group is determined at the upper group-specific lower group number determination step; an upper group number final confirmation step of finally confirming the determined number of upper groups; an upper group addition and deletion confirmation step of confirming whether to add or to exclude an upper group, if it has been tried at the upper group number final confirmation step to change the number of upper groups; an upper group addition step of determining the number of upper groups to be added, and returning to the upper group entrance door control/recognition means determination step, if it is confirmed at the upper group addition and deletion confirmation step to add an upper group; an exclusion target upper group selection step of selecting upper groups to be excluded among the previously determined upper groups, if it is confirmed at the upper group addition and deletion confirmation step to exclude some of the set upper groups; a selected upper group deletion step of deleting the upper groups selected at the exclusion target upper group selection step, and returning to the upper group number final confirmation step; a lower group number final confirmation step of finally confirming the number of lower groups corresponding to each upper group; a changed upper group number selection step of selecting an upper group to be changed among the upper groups, if it is confirmed at the lower group number final confirmation step to change the number of lower groups corresponding to each determined upper group; a lower group addition and deletion confirmation step of confirming whether to add or to exclude a lower group of the upper group selected at the changed upper group number selection step; a lower group addition step of determining the number of lower groups to be added, and returning to the lower group entrance door control/recognition means determination step, if it is confirmed at the lower group addition and deletion confirmation step to add a lower group; an exclusion target lower group selection step of selecting a lower group to be excluded among the previously determined lower groups, if it is confirmed at lower group addition and deletion confirmation step to exclude a lower group; and a selected lower group deletion step of deleting the lower group selected at the exclusion target lower group selection step, and returning to the lower group number final confirmation step.

In the access right management method of an access control system of the present invention as described above, the visitor's basic condition setting step includes: a target visitor personnel information calling step of inputting ID information of a corresponding visitor and calling personnel information of the visitor; a target visitor personnel information receiving step of receiving synchronized personnel information of a corresponding visitor called at the target visitor personnel information calling step from the personnel management server; a basic condition compositional factor checking step of checking personnel information corresponding to a compositional factor of a basic condition from the personnel information of a corresponding visitor received through the target visitor personnel information receiving step; and a visitor access right setting step of assigning identification codes of upper and lower group visitor recognition means permitted to access according to the corresponding personnel information checked at the basic condition compositional factor checking step.

In the access right management method of an access control system of the present invention as described above, the visitor's special condition setting step includes: a special condition compositional factor checking step of checking personnel information corresponding to a compositional factor of a special condition from the personnel information previously received from the personnel management server through the visitor's basic condition setting step; a special condition information confirmation step of confirming whether there is personnel information corresponding to a compositional factor of a special condition in the personnel information checked at the special condition compositional factor checking step; a body feature information confirmation step of confirming whether there is personnel information of body features in the corresponding personnel information, if it is confirmed at the special condition information confirmation step that there is personnel information corresponding to a compositional factor of a special condition; a special passage time setting step of setting a special passage time longer than a basic passage time for a corresponding visitor, if it is confirmed at the body feature information confirmation step that there is personnel information of body features; a disease feature information confirmation step of confirming whether there is personnel information of disease features in the corresponding personnel information, if it is confirmed at the body feature information confirmation step that there is no personnel information of body features or the special passage time setting step is completed; an access control setting step of setting access blocking to the upper and lower group visitor recognition means permitted to a corresponding visitor, if it is confirmed at the disease feature information confirmation step that there is personnel information of disease features; a special target information confirmation step of confirming whether there is personnel information of a special target person in the corresponding personnel information, if it is confirmed at the disease feature information confirmation step that there is no personnel information of disease features or the access control setting step is completed; and a special target mode setting step of setting permission of access to all the upper and lower group visitor recognition means and designated transportation means installed in the facility to a preset state for the corresponding visitor, if it is confirmed at the special target information confirmation step that there is personnel information of a special target person.

The present invention for accomplishing the object provides a computer-readable recording medium recording a program performing the access right management method of an access control system for controlling visitors.

DESCRIPTION OF SYMBOLS

Figure 1:
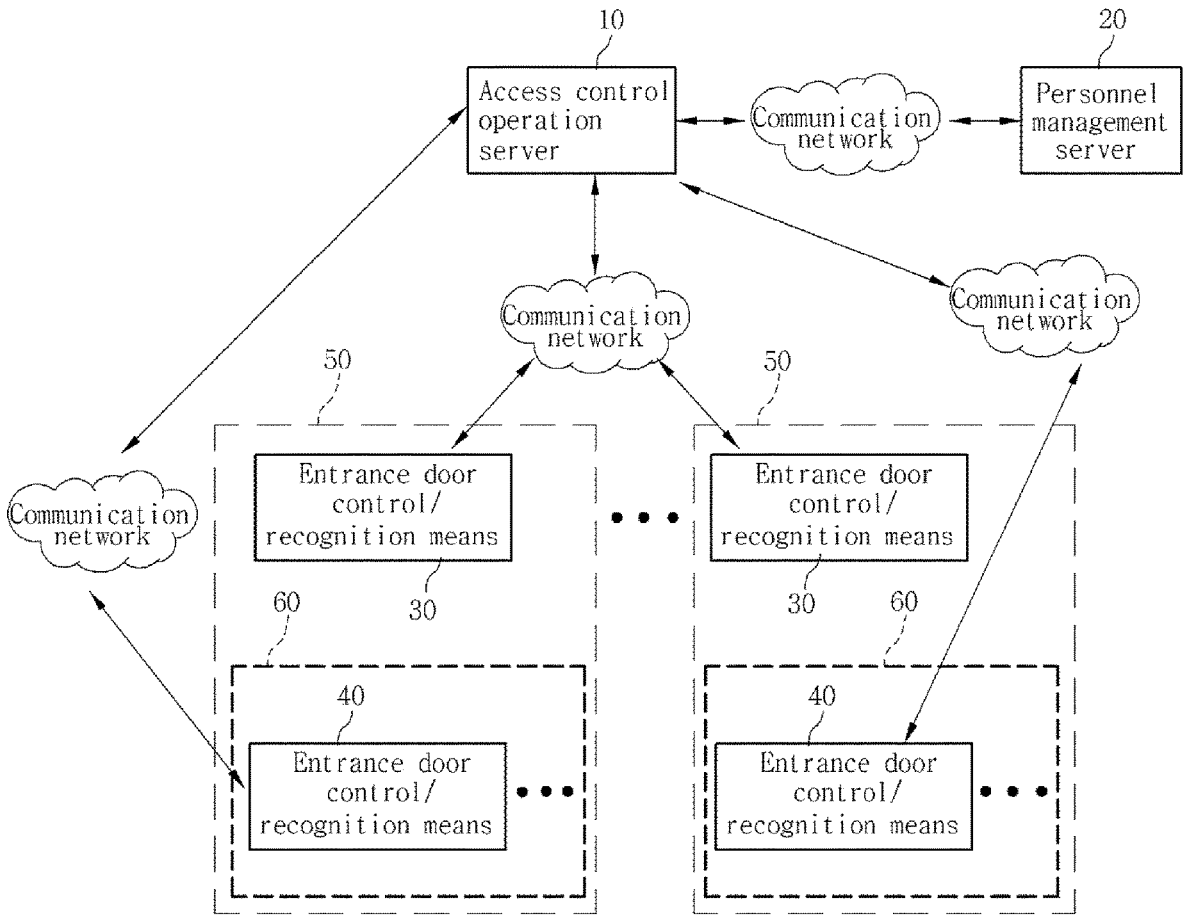
FIG. 1 is a block diagram schematically showing the configuration of an access control system and a close interrelationship among constitutional components.

S100: Risk response operation setting step
S200: Access group forming step
S300: Visitor's basic condition setting step
S400: Visitor's special condition setting step
S500: Visitor access right value generation and registration step
S600: Visitor addition conformation step
S700: Interrupt information reception conformation step
S800: Basic condition information conformation step
S900: Basic condition re-setting step
S1000: Special condition information conformation step
S1100: Special condition re-setting step

DETAILED DESCRIPTION OF THE PREFERRED EMBODIMENT

Hereafter, the present invention will be described in more detail with reference to the accompanying drawings.

Prior to this, the terms and words used in this specification and the claims should not be interpreted as being limited to commonly-used or dictionary meanings, but should be interpreted as meanings and concepts relevant to the technical spirits of the invention based on the fact that the inventor may properly define the concept of the terms to explain the invention in best ways.

Therefore, the embodiments described in the specification and the configurations depicted in the drawings are only most preferable embodiments and do not represent all technical spirits of the invention, so it should be understood that various equivalents and modifications that can substitute for them may exist at the time of filing this application.

An access right management method of an access control system according to the present invention will be described with reference to the accompanying drawings.

FIG. 1 illustrates the configuration of an access control system and a close interrelationship among constitutional components, and the access control system includes an access management server connected to a personnel management server 20 through a bidirectional communication network to have synchronized personnel information, and a plurality of entrance door control/recognition means 30 and 40 installed at an entrance door of each access space 50 and 60 partitioned into a plurality of diverse areas to recognize visitors and lock/unlock the entrance door, and connected to the access control server 10, respectively, and the access control system controls visitors so that only permitted visitors may access each of upper and lower groups 50 and 60.

Figure 2:
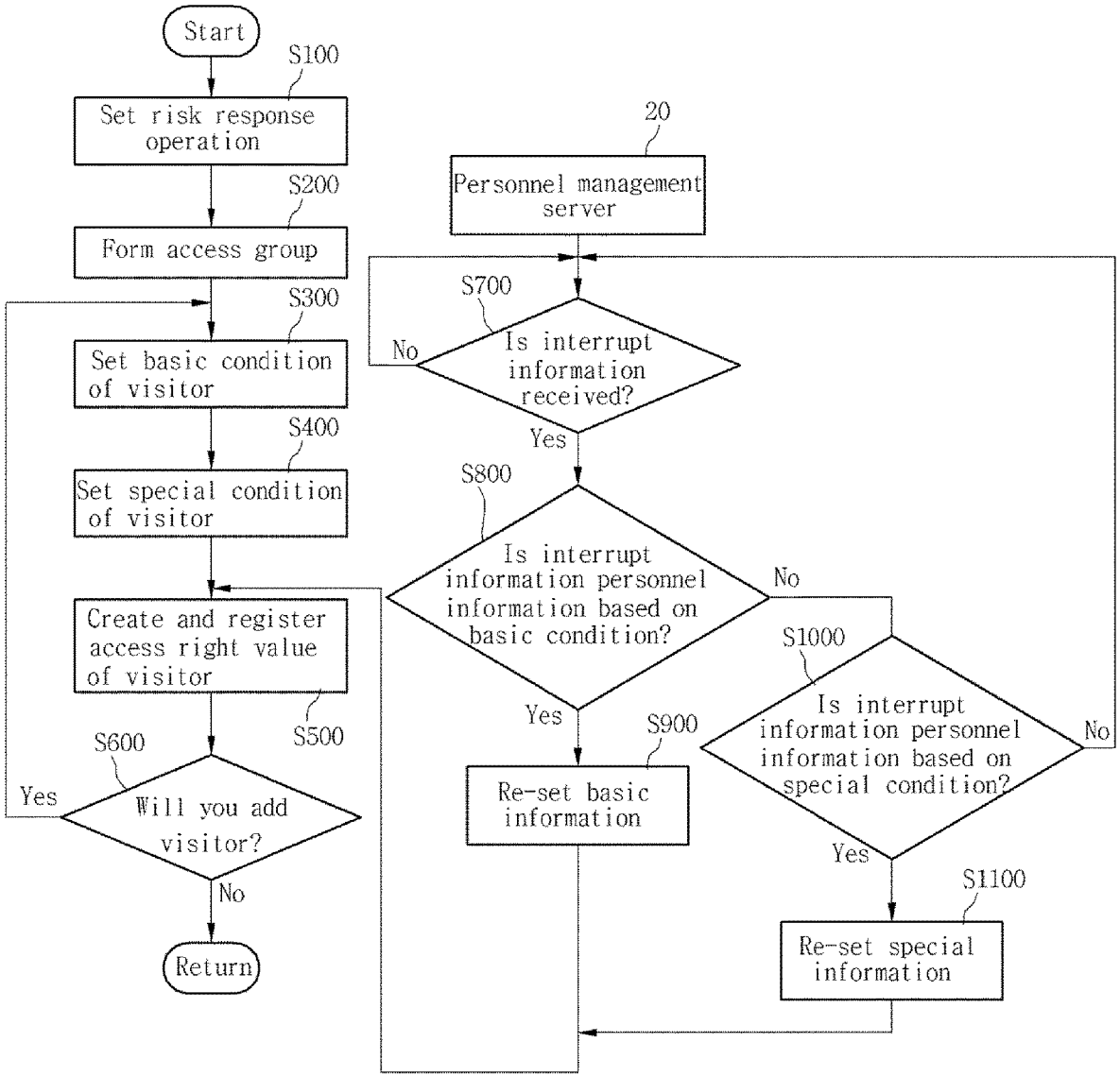
FIG. 2 is a flowchart illustrating the configuration of an access right management method of an access control system according to the present invention and a close interrelationship among constitutional components.

Referring to FIGS. 1 and 2, the access right management method of the access control system according to the present invention includes a risk response operation setting step S100, an access group forming step S200, a visitor's basic condition setting step S300, a visitor's special condition setting step S400, a visitor access right value generation and registration step S500, a visitor addition conformation step S600, an interrupt information reception conformation step S700, a basic condition information conformation step S800, a basic condition re-setting step S900, a special condition information conformation step S1000, and a special condition re-setting step S1100.

The risk response operation setting step S100 is a step of setting a response operation in response to generation of a risk such as a fire, an earthquake, a terror or a trespass, and when the response operation is set, the step maintains the entrance door control/recognition means corresponding to emergency exits in an unlocked state so that visitors may quickly evacuate as is instructed in a response manual.

Figure 3:
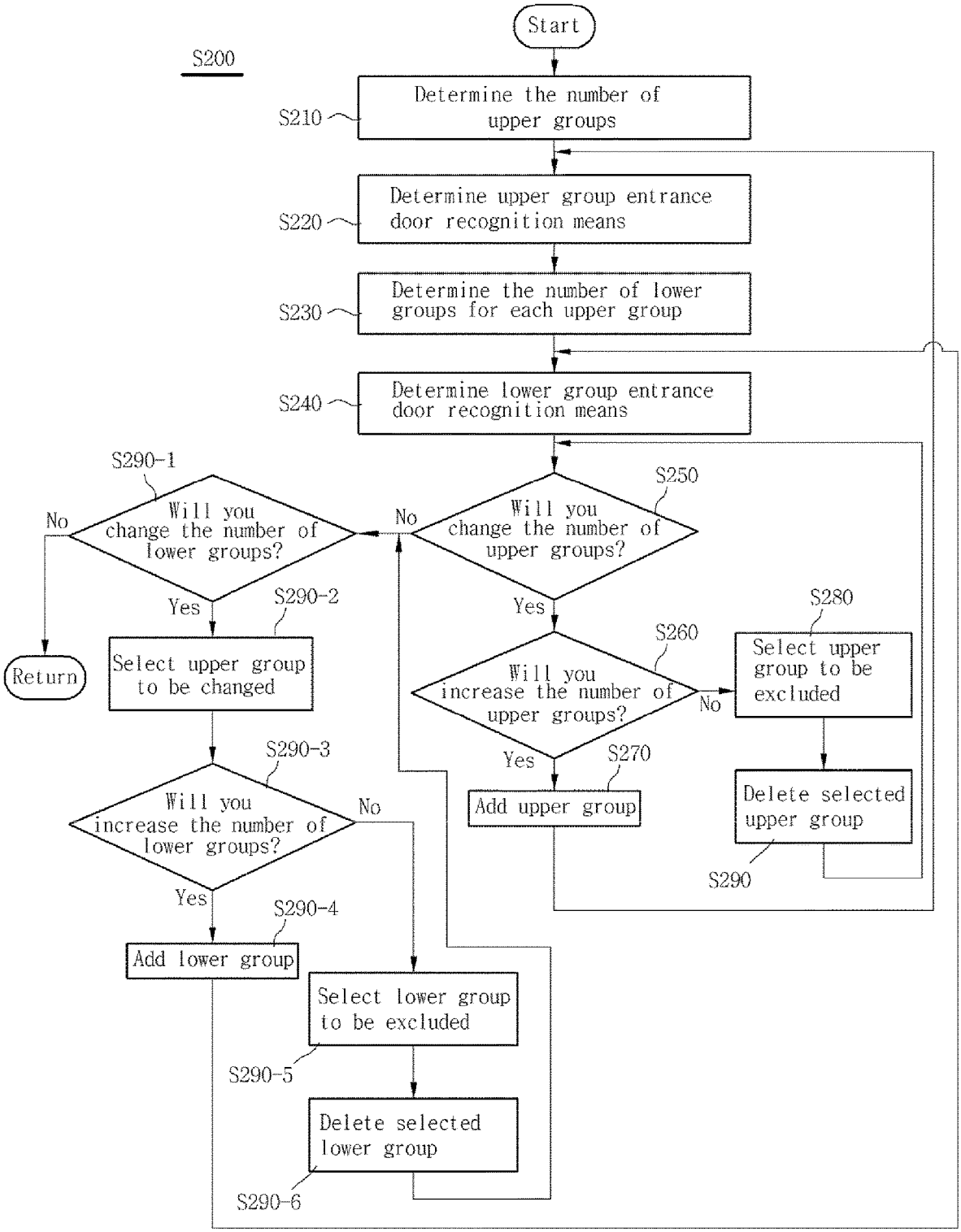
FIG. 3 is a flowchart illustrating the configuration of an access group forming step of the access right management method of an access control system according to the present invention as shown in FIG. 2 and a close interrelationship among constitutional components.

Referring to FIGS. 2 and 3, when the risk response operation setting step S100 is completed, the access group forming step S200 forms one or more upper and lower groups by partitioning a space into as many spaces as needed, assigns an identification code to each of the upper and lower groups, and determines a type of the entrance door control/recognition means for each identification code, and the access group forming step S200 includes: an upper group number determination step S210, an upper group entrance door control/recognition means determination step S220, an upper group-specific lower group number determination step S230, an lower group entrance door control/recognition means determination step S240, an upper group number final confirmation step S250, an upper group addition and deletion confirmation step S260, an upper group addition step S270, an exclusion target upper group selection step S280, a selected upper group deletion step S290, a lower group number final confirmation step S290-1, a changed upper group number selection step S290-2, a lower group addition and deletion confirmation step S290-3, a lower group addition step S290-4, an exclusion target lower group selection step S290-5, and a selected lower group deletion step S290-6.

The upper group number determination step S210 determines the number of needed upper groups.

If the number of upper groups is determined at the upper group number determination step S210, the upper group entrance door control/recognition means determination step S220 determines an upper group entrance door control/recognition means 30 of an entrance door for entering the upper group 50 and assigns an identification code to each upper group entrance door control/recognition means 30.

The upper group-specific lower group number determination step S230 determines the number of lower groups 60 corresponding to each upper group 50.

If the number of lower groups 60 in each upper group 50 is determined at the upper group-specific lower group number determination step S230, the lower group entrance door control/recognition means determination step S240 determines a lower group entrance door control/recognition means 40 of an entrance door for entering each lower group 60 and assigns an identification code to each lower group entrance door control/recognition means 40.

The upper group number final confirmation step S250 finally confirms the determined number of upper groups 50.

If it has been attempted to change the number of upper groups 60 at the upper group number final confirmation step S250, the upper group addition and deletion confirmation step S260 confirms whether to add or to exclude an upper group 50.

If it is confirmed at the upper group addition and deletion confirmation step S260 to add an upper group 50, the upper group addition step S270 determines the number of upper groups 50 to be added, and the process returns to the upper group entrance door control/recognition means determination step S220.

If it is confirmed at the upper group addition and deletion confirmation step S260 to exclude some of the set upper groups 50, the exclusion target upper group selection step S280 selects upper groups to be excluded among the previously determined upper groups 50.

The selected upper group deletion step S290 deletes the upper groups selected at the exclusion target upper group selection step S280, and the process returns to the upper group number final confirmation step S250.

The lower group number final confirmation step S290-1 finally confirms the number of lower groups 60 corresponding to each upper group 50.

If it is confirmed at the lower group number final confirmation step S290-1 to change the number of lower groups 60 corresponding to each determined upper group 50, the changed upper group number selection step S290-2 selects an upper group 50 to be changed among the upper groups 50.

The lower group addition and deletion confirmation step S290-3 confirms whether to add or to exclude a lower group of the upper group 50 selected at the changed upper group number selection step S290-2.

If it is confirmed at the lower group addition and deletion confirmation step S290-3 to add a lower group 60, the lower group addition step S290-4 determines the number of lower groups 60 to be added, and the process returns to the lower group entrance door control/recognition means determination step S240.

If it is confirmed at lower group addition and deletion confirmation step S290-3 to exclude a lower group 60, the exclusion target lower group selection step S290-5 selects a lower group to be excluded among the previously determined lower groups 60.

The selected lower group deletion step S290-6 deletes the lower group selected at the exclusion target lower group selection step S290-5, and the process returns to the lower group number final confirmation step S290-1.

Figure 4:
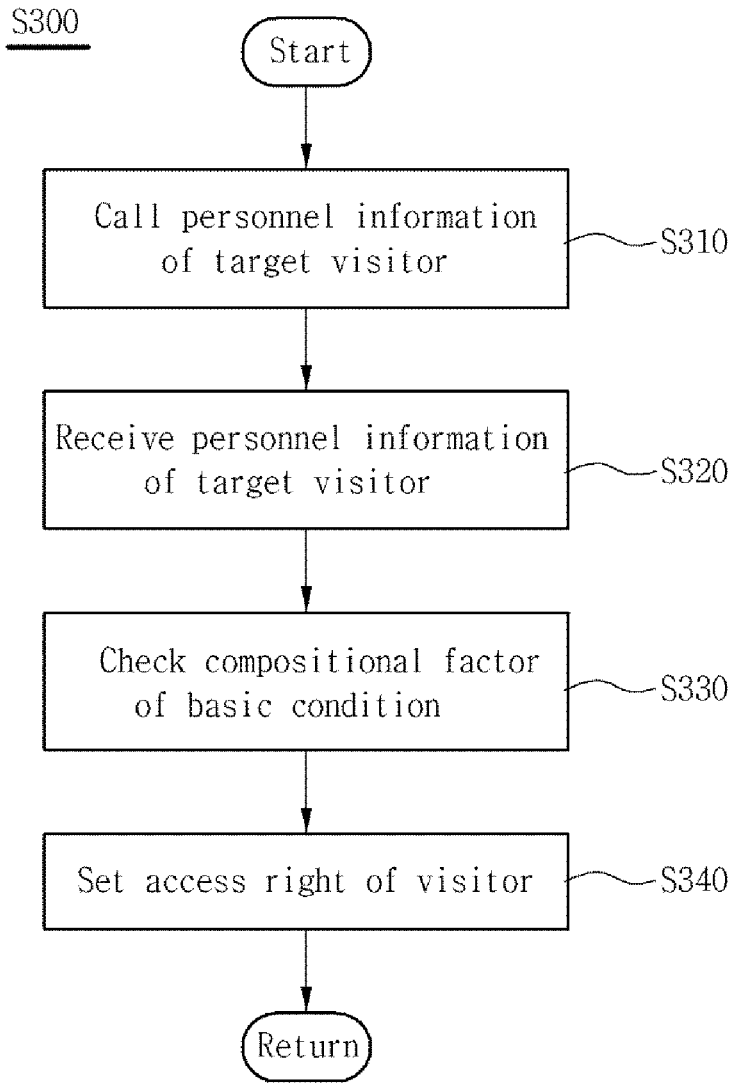
FIG. 4 is a flowchart illustrating the configuration of a visitor's basic condition setting step of the access right management method of an access control system according to the present invention as shown in FIG. 2 and a close interrelationship among constitutional components.

Referring to FIGS. 2 and 4, the visitor's basic condition setting step S300 sets basic conditions of a visitor when the access group forming step S200 is completed and includes a target visitor personnel information calling step S310, a target visitor personnel information receiving step S320, a basic condition compositional factor checking step S330, a visitor access right setting step S340.

The target visitor personnel information calling step S310 inputs ID information of a corresponding visitor and calls personnel information of the visitor.

The target visitor personnel information receiving step S320 receives synchronized personnel information of a corresponding visitor called at the target visitor personnel information calling step S310 from the personnel management server 20.

The basic condition compositional factor checking step S330 checks personnel information corresponding to a compositional factor of a basic condition from the personnel information of a corresponding visitor received through the target visitor personnel information receiving step S320.

The visitor access right setting step S340 assigns identification codes of upper and lower group visitor recognition means 30 and 40 permitted to access according to corresponding personnel information checked at the basic condition compositional factor checking step S330.

Figure 5:
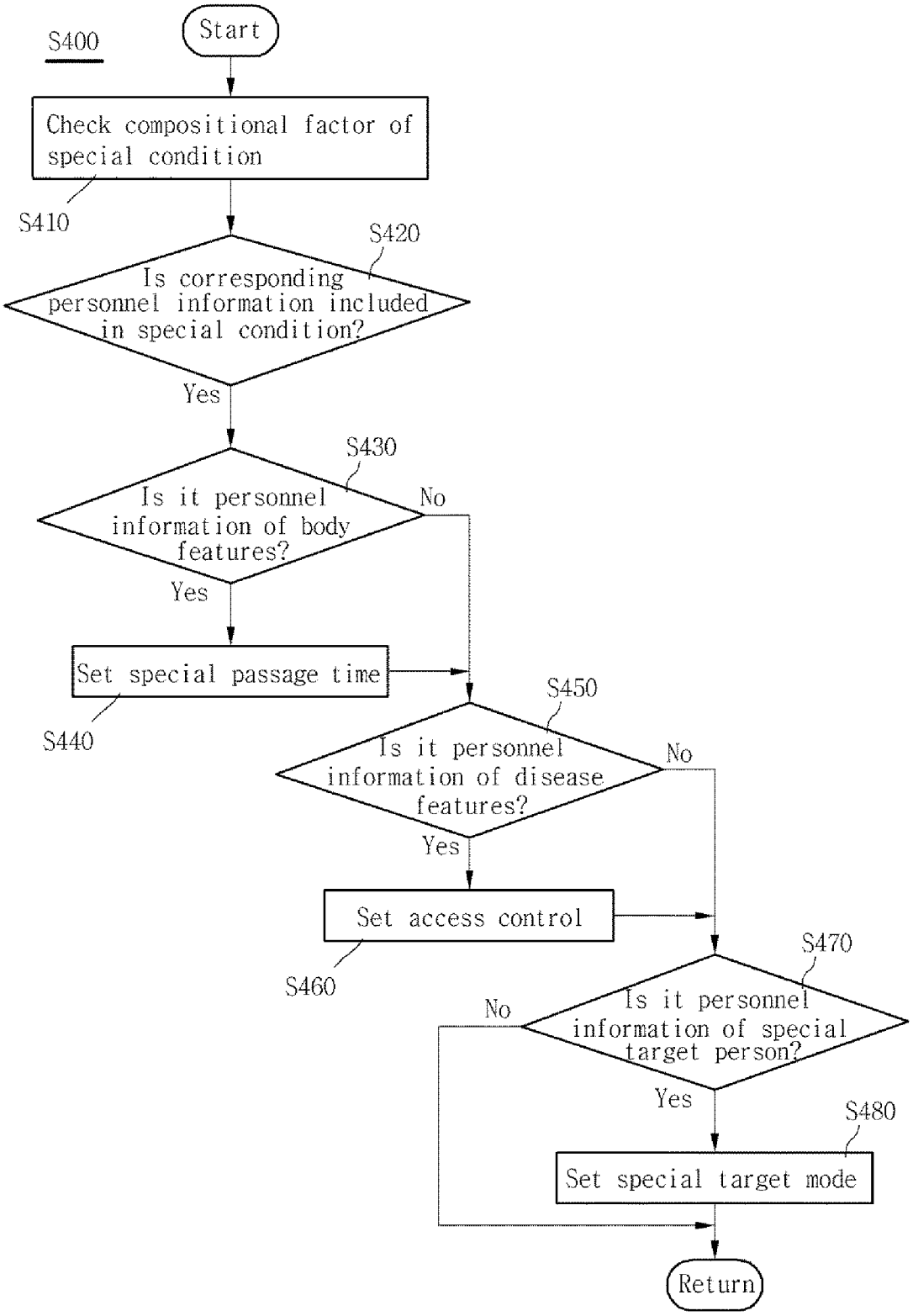
FIG. 5 a flowchart illustrating the configuration of a visitor's special condition setting step of the access right management method of an access control system according to the present invention as shown in FIG. 2 and a close interrelationship among constitutional components.

Referring to FIGS. 2 and 5, the visitor's special condition setting step S400 sets special conditions of a visitor for whom basic conditions are set at the access group forming step S200 and includes a special condition compositional factor checking step S410, a special condition information confirmation step S420, a body feature information confirmation step S430, a special passage time setting step S440, a disease feature information confirmation step S450, an access control setting step S460, a special target information confirmation step S470, and a special target mode setting step S480.

The special condition compositional factor checking step S410 checks personnel information corresponding to a compositional factor of a special condition from the personnel information previously received from the personnel management server 20 through the visitor's basic condition setting step S300.

The special condition information confirmation step S420 confirms whether there is personnel information corresponding to a compositional factor of a special condition in the personnel information checked at the special condition compositional factor checking step S410.

If it is confirmed at the special condition information confirmation step S420 that there is personnel information corresponding to a compositional factor of a special condition, the body feature information confirmation step S430 confirms whether there is personnel information of body features in the corresponding personnel information.

If it is confirmed at the body feature information confirmation step S430 that there is personnel information of body features, the special passage time setting step S440 sets a special passage time longer than a basic passage time for a corresponding visitor.

If it is confirmed at the body feature information confirmation step S430 that there is no personnel information of body features or the special passage time setting step S440 is completed, the disease feature information confirmation step S450 confirms whether there is personnel information of disease features in the corresponding personnel information.

If it is confirmed at the disease feature information confirmation step S450 that there is personnel information of disease features, the access control setting step S460 sets access blocking to the upper and lower group visitor recognition means 30 and 40 permitted to a corresponding visitor.

If it is confirmed at the disease feature information confirmation step S450 that there is no personnel information of disease features or the access control setting step S460 is completed, the special target information confirmation step S470 confirms whether there is personnel information of a special target person in the corresponding personnel information.

If it is confirmed at the special target information confirmation step S470 that there is personnel information of a special target person, the special target mode setting step S480 sets permission of access to all the upper and lower group visitor recognition means 30 and 40 and designated transportation means installed in the facility to a preset state for a corresponding visitor.

Referring to FIG. 2 again, when the visitor's special condition setting step S400 is completed, the visitor access right value generation and registration step S500 generates an access right value of a corresponding visitor and registers the generated access right value X.

The access right value X of the visitor is generated by 'ⓐ Entrance door control/recognition means+(ⓑ Basic condition+ⓒ Special condition)+ⓓ Risk response'.

The ⓐ entrance door control/recognition means includes: ⓐ-1 an upper group entrance door control/recognition means installed at an entrance door of a common group including a lower group that visitors may commonly use and pass through, such as a lobby, a staircase a corridor and the like; ⓐ-2 upper and lower group entrance door control/recognition means installed at each entrance door of lower groups partitioned into departments dealing with secret information of an organization such as a research team, an information protection team, a financial accounting team and the like, and installed at an entrance door of an upper group including the lower groups; ⓐ-3 upper and lower group entrance door control/recognition means installed at each entrance door of lower groups partitioned into installation spaces of a facility for controlling power, water supply, and cooling and heating environment of a building such as an electric room, a machine room, an air conditioning room and the like, and installed at an entrance door of an upper group including the lower groups; ⓐ-4 upper and lower group entrance door control/recognition means installed at each entrance door of lower groups in which communication facilities such as an EDPS room, a machine room, a communication room and the like are installed, and installed at an entrance door of an upper group including the lower groups; and ⓐ-5 upper and lower core security group entrance door control/recognition means installed at each entrance door of lower groups partitioned into installation spaces of a facility for controlling equipment of a building, storing important things, and managing situations in a management area, such as a disaster prevention room, a safe, a central control room, a secret document storage room and the like, and installed at an entrance door of an upper group including the lower groups.

The ⓑ basic condition includes: ⓑ-1 access permitted area unit information including an area unit to which access of a visitor is permitted, such as a headquarter, a branch, a research center or the like; ⓑ-2 upper department information including information on a direct upper department, to which a visitor belongs, such as an administrative department, a general affair department, a strategy and financial department, a land affair department or the like; ⓑ-3 lower department information including information on direct lower units belonging to a direct upper department to which a visitor belongs, such as an EDPS room, a strategy room, an electric room or the like; and ⓑ-4 personnel information including personnel information of a visitor, such as a sex, a name, a position, a hired date and the like.

The ⓒ special condition includes: ⓒ-1 a body feature setting unit for setting body features (disability, pregnancy or the like) of a visitor; ⓒ-2 a disease feature setting unit for setting whether a visitor has a disease feature (infectious disease); and ⓒ-3 a special target setting unit for setting whether a visitor is a special target person (a VIP, an executive or the like).

The ⓓ risk response includes: ⓓ-1 a fire response entrance door setting unit for setting whether an entrance door is a fire response target in case a fire alarm; ⓓ-2 an earthquake response entrance door setting unit for setting whether an entrance door is an earthquake response target in case of an earthquake alarm; ⓓ-3 a terror response entrance door setting unit for setting whether an entrance door is a terror response target in case of a terror; and ⓓ-4 an alarm response entrance door setting unit for setting whether an entrance door is an alarm response target in case of a trespass.

Referring to FIG. 2 again, when the visitor access right value generation and registration step S500 is completed, the visitor addition conformation step S600 confirms whether there is a visitor to be added, and if there is a visitor to be added, the process returns to the visitor's basic condition setting step S300.

The interrupt information reception conformation step S700 confirms whether interrupt information according to change of personnel information is received from the personnel management server 20.

When the interrupt information is received at the interrupt information reception conformation step S700, the basic condition information conformation step S800 confirms whether the received interrupt information is personnel information corresponding to basic condition information.

If it is confirmed at the basic condition information conformation step S800 that the received interrupt information is personnel information corresponding to basic condition information, the basic condition re-setting step S900 re-sets the basic information on a corresponding visitor, and the process returns to the visitor access right value generation and registration step S500.

If it is confirmed at the basic condition information conformation step S800 that the received interrupt information is not the basic condition information, the special condition information conformation step S1000 confirms whether the received interrupt information is personnel information corresponding to special condition information, and if the received interrupt information is not personnel information corresponding to the special condition information, the process returns to the interrupt information reception conformation step S700.

If it is confirmed at the special condition information conformation step S1000 that the received interrupt information is personnel information corresponding to special condition information, the special condition re-setting step S1100 re-sets the special condition of a corresponding visitor, and the process returns to the visitor access right value generation and registration step S500.

The access right management method of the access control system according to the present invention having the configuration as described above has an advantage of maximizing efficiency of operating the access management and preventing damages caused by illegal access of an unpermitted visitor by fetching a synchronized personnel information file from a personnel management server and automatically checking whether there is personnel information corresponding to a factor for determining an access right in personnel information in the personnel information file; automatically identifying personnel information corresponding to the factor if the personnel information exists, automatically generating an access right value of a corresponding visitor by matching the personnel information to an entrance door recognition device of each access group corresponding to the personnel information, and registering and storing the access right value in an access control operation server; and creating and registering an access right value of a previously registered visitor by reflecting updated personnel information in real-time even when the personnel information is frequently changed later.

The access right management method of the access control system according to an embodiment of the present invention may be implemented in the form of a program that can be read through various computer means and recorded in a computer-readable recording medium.

According to the access right management method of an access control system and a computer-readable medium recording a program for performing the method according to the present invention, there is an effect of maximizing efficiency of operating the access management and preventing damages caused by illegal access of an unpermitted visitor by fetching a synchronized personnel information file from a personnel management server and automatically checking whether there is personnel information corresponding to a factor for determining an access right in personnel information in the personnel information file; automatically identifying personnel information corresponding to the factor if the personnel information exists, automatically generating an access right value of a corresponding visitor by matching the personnel information to an entrance door control/recognition means of each upper or lower group corresponding to the personnel information, and registering and storing the access right value in an access control operation server; and creating and registering an access right value of a previously registered visitor by reflecting updated personnel information in real-time even when the personnel information is frequently changed later.

Although it has been described in the present invention on the basis of specific items, such as specific constitutional component and the like, limited embodiments and drawings, this is provided only to help further general understanding of the present invention, and the present invention is not limited to the above embodiments, and those skilled in the art may make diverse changes and modifications from the description.

Accordingly, the spirit of the present invention should not be limited to the described embodiments, and all that are equal to the claims or having equivalent modifications, as well as the claims described below, fall within the scope of the present invention.

What is claimed is:

1. An access right management method of an access control system including an access control operation server and a personnel management server, wherein the access control operation server and the personnel management server are connected through a bidirectional communication network for controlling visitors, the method comprising:

setting, by the access control operation server, a risk response operation for at least one of fire, an earthquake, a terror attack, and a trespass;

forming one or more upper and lower groups by partitioning a space into as many spaces as needed, assigning an identification code to each of the upper and lower groups, and determining a type of an entrance door control/recognition means for each identification code;

setting basic conditions for a visitor;

setting special conditions for the visitor for whom the basic conditions are set;

generating an access right value for the visitor and registering the generated access right value;

confirming whether to add the visitor when the visitor access right value generation and registration step are completed, and wherein if the visitor is added returning to the basic conditions for the visitor setting step;

confirming whether interrupt information according to change of personnel information is received from the personnel management server;

confirming whether the received interrupt information is the personnel information correspond to the basic condition information;

re-setting the basic information on the visitor if it is confirmed that the received interrupt information is the personnel information corresponding to the basic condition information, and returning to the visitor access right value generation and registration step;

confirming whether the received interrupt information is personnel information corresponding to special condition information if it is confirmed at the basic condition information confirmation step that the received interrupt information is not the basic condition information, and returning to the interrupt information reception confirmation step if the received interrupt information is not the personnel information corresponding to the special condition information; and re-setting the special condition of the visitor if it is confirmed at the special condition information confirmation step that the received interrupt information is the personnel information corresponding to the special condition information, and returning to the visitor access right value generation and registration step.

2. The method according to claim 1, wherein forming the one or more upper and lower groups step includes:

determining the number of upper groups needed;

assigning the identification code to each of the upper groups entrance door control/recognition means;

determining the number of lower groups corresponding to each of the upper groups;

determining assigning the identification code to each of the lower groups entrance door control/recognition means;

confirming the determined number of upper groups;

confirming whether to add or delete one of the upper groups;

determining the number of upper groups to be added;

adding the upper groups selected to be added, and returning to the upper groups entrance door control/recognition means determination step, if it is confirmed to add the upper groups;

selecting the upper groups to be deleted among the previously determined upper groups, if it is confirmed to delete one of the upper groups;

deleting the upper groups selected to be deleted, and returning to the upper group number final confirmation step;

confirming the number of lower groups corresponding to each of the upper groups;

selecting an upper group to be changed among the upper groups, if it is confirmed at the lower group number confirmation step to change the number of lower groups corresponding to each determined upper group;

confirming whether to add or delete one of the lower groups;

determining the number of lower groups to be added, and returning to the lower group entrance door control/recognition means determination step, if it is confirmed to add a lower group;

selecting the lower group to be deleted among the previously determined lower groups, if it is confirmed to delete one of the lower groups; and deleting the lower group selected to be deleted, and returning to the lower group number final confirmation step.

3. The method according to claim 1, wherein setting the basic conditions of the visitor step includes:

inputting ID information of the visitor and calling personnel information of the visitor;

receiving the personnel information of the visitor from the personnel management server;

checking personnel information corresponding to a compositional factor; and assigning identification codes of upper and lower group visitor recognition means permitted to access according to the corresponding personnel information.

4. The method according to claim 1, wherein setting the special conditions of the visitor step includes:

checking personnel information corresponding to a compositional factor of a special condition from the personnel information received from the personnel management server at the basic condition setting step;

confirming whether the personnel information corresponds to the compositional factor of the special condition in the personnel information;

confirming whether there is personnel information of body features in the personnel information;

setting a special passage time longer than a basic passage time for the visitor, if there is personnel information of body features;

confirming whether there is personnel information of disease features in the personnel information, if it is confirmed at the body feature information confirmation step that there is no personnel information of body features or a special passage time setting step is completed;

blocking access to the upper and lower group visitor recognition means permitted to the visitor, if it is confirmed at the disease feature information confirmation step that there is personnel information of disease features;

confirming whether there is personnel information of a special target person in the personnel information, if it is confirmed at the disease feature information confirmation step that there is no personnel information of disease features or the access control setting step is completed; and setting permission of access to all the upper and lower group visitor recognition means and designated transportation means installed in a facility to a preset state for the visitor, if it is confirmed at the special target information confirmation step that there is personnel information of a special target person.

5. The method according to claim 1, wherein the access right value X of the visitor is generated by the entrance door control/recognition means+the basic condition+the special condition+the risk response.

6. The method according to claim 5, wherein the basic condition includes:

access permitted area unit information including an area unit including a headquarter, a branch, or a research center to which access of a visitor is permitted;

upper department information including information on a direct upper department including an administrative department, a general affair department, a strategy and financial department, and a land affair department, to which a visitor belongs;

lower department information including information on direct lower units including an EDPS room, a strategy room, and an electric room belonging to a direct upper department to which a visitor belongs; and personnel information of a visitor including a sex, a name, a position, and a hired date.

7. The method according to claim 5, wherein the special condition includes at least one of disability, pregnancy, infectious disease, executive, and VIP.

8. A non-transitory computer-readable recording medium recording a program performing the access right management method of the access control system for controlling visitors according to claim 1.

* * * * *